US007717050B2

(12) United States Patent
Park

(10) Patent No.: US 7,717,050 B2
(45) Date of Patent: May 18, 2010

(54) PRESSER FOOT DRIVE STRUCTURE FOR EMBROIDERY MACHINE

(75) Inventor: Chan Soo Park, Seoul (KR)

(73) Assignee: Sunstar Precision Co., Ltd., Incheon (KR)

( * ) Notice: Subject to any disclaimer, the term of this patent is extended or adjusted under 35 U.S.C. 154(b) by 188 days.

(21) Appl. No.: 12/016,497

(22) Filed: Jan. 18, 2008

(65) Prior Publication Data

US 2009/0249990 A1 Oct. 8, 2009

(51) Int. Cl.
*D05B 29/02* (2006.01)
*D05B 69/02* (2006.01)

(52) U.S. Cl. ..... 112/284; 112/236

(58) Field of Classification Search ..... 112/235–240
See application file for complete search history.

(56) References Cited

U.S. PATENT DOCUMENTS 3,815,529 A * 6/1974 Adams et al. ..... 112/450
3,815,532 A * 6/1974 Weisz et al. ..... 112/221
4,292,907 A * 10/1981 Gilbride et al. ..... 112/236
5,590,614 A * 1/1997 Murata et al. ..... 112/237
5,653,185 A * 8/1997 Badillo ..... 112/240
5,694,872 A * 12/1997 Zeller ..... 112/235
7,571,689 B2 * 8/2009 Joe ..... 112/236

* cited by examiner

*Primary Examiner*—Ismael Izaguirre
(74) *Attorney, Agent, or Firm*—LRK Patent Law Firm

(57) ABSTRACT

A presser foot drive structure of an embroidery machine, by which a vertically movable presser foot for preventing a sheet of cloth to be sewn from rising in a sewing operation is vertically moved inside a sewing head. The presser foot drive structure includes a presser foot drive holder, which is vertically slidable and is mounted on the outer circumference of a needle bar, which is vertically driven; a presser foot drive shaft, which is disposed parallel to the needle bar via the presser foot drive holder; and the presser foot, which is disposed at the lower end of the presser foot drive shaft and vertically reciprocates. It is possible to reduce the stroke of a presser foot so that it is smaller than that of a needle bar, enhance the supporting force for a needle bar, and reduce the shaking of a presser foot.

8 Claims, 7 Drawing Sheets

PRESSER FOOT DRIVE STRUCTURE FOR EMBROIDERY MACHINE

BACKGROUND OF THE INVENTION

1. Field of the Invention

The present invention relates to embroidery machine, and more particularly, to a presser foot drive structure for embroidery machine.

2. Description of the Related Art

As well known in the art, an industrial embroidery machine is a type of machine in which an embroidery frame fixing a sheet of fabric moves horizontally in x- and y-axial directions in order to embroider a desired pattern on the fabric, while a needle bar capable of sewing moves up and down. A sewing machine carries a sheet of fabric using a geared carriage to sew the fabric sheet. In contrast, the embroidery machine performs needlework while the embroidery frame, fixing the sheet of fabric, is carried in x- and y-axial directions. Accordingly, the precise and constant-speed movement of the embroidery frame has a close relationship with the quality of an embroidered pattern.

Thus, as a source of power for driving the needle bar of the embroidery machine in a vertical direction, a servo motor, an induction motor, the speed of which can be controlled, or the like is used. As a power source for carrying the embroidery frame in x- and y-axial directions, a stepping motor, which ensures good positioning and is easy to control, is typically used.

Generally, 12 to 24 sewing machines are connected with each other along one spindle in order to improve the productivity of embroidery machine. Since the sheet of fabric must be sewn with various colors of thread corresponding to an embroidery design, each sewing machine has 6 to 12 needle bars, which are equipped with different colors of thread.

These days, users are demanding the ability to easily input, copy and store embroidery designs while performing simple editing on the designs. The users are also demanding various functions, such as an automatic thread color change function, which is enabled according to an embroidery design, a trimming function of automatically cutting a thread when sewing is finished, a function of interrupting the operation of the machine and raising an alarm when a thread is inadvertently cut, an outage restoration function of restarting the embroidery machine when the sewing machine stops due to a power failure, and the like.

In addition to the above-mentioned attempts to improve embroidery quality, embroidery machine providers are adopting industrial computers or microcomputers to embroidery machines in order to meet user demands for multi-functional embroidery machine operation.

FIG. 1 is a perspective and partially expanded view illustrating an embroidery machine of the prior art, FIG. 2A is a perspective view illustrating a presser foot drive structure of the embroidery machine of the prior art, and FIG. 2B is an expanded view of part "A" of FIG. 2A. As shown in FIG. 1, a plurality of sewing heads is arranged in the front portion of a sewing machine 1, along the length thereof. In the front portion of a sewing arm 3 of each sewing head, there is provided a needle bar support case 4, which has a plurality of presser feet 5 acting as cloth pressing members.

The presser foot 5 serves to prevent a sheet of cloth to be sewn from coming loose when it is being sewn, and is provided so as to be vertically movable in cooperation with a needle bar (see the reference number 6 in FIG. 2A).

As shown in FIGS. 2A and 2B, the needle bar 6 acts as a guide shaft for the vertical movement of the presser foot 5.

Presser foot supports 12 and 13 for mounting the presser foot 5 on the needle bar 6 in a vertically and reciprocally movable fashion are located in two places on the presser foot 5, such as the top end and the middle section of the presser foot 5, so that a needle bar holder 14 at the bottom end of the needle bar 6 does not pass through the middle section of the presser foot 5. This acts as a factor limiting the reduction of the stroke of the presser foot 5, that is, the distance between the upper dead point and the lower dead point of the presser foot 5.

The needle bar 6, which should always have a predetermined stroke length, vertically moves through the middle section of the presser foot 5. In the vertical movement of the presser foot 5, in order to avoid excessive interference with the needle bar holder 14, the stroke of the presser foot 5 should have a predetermined length that is determined according to the stroke of the needle bar 6.

When the presser foot 5 is located at the lower dead point 5, a predetermined gap is always maintained between a pressing portion, which presses the sheet of cloth to be sewn, and the middle section, which is slidably supported on the needle bar. Thus, in the presser foot 5 pressing portion, where the sheet of cloth to be sewn is pressed, supporting force for the needle bar 6 is unreliable. Since the needle bar 6 is assembled through the presser foot 5, it is complicated to replace the presser foot 5 when it is fractured or broken. It is also necessary to disassemble the needle bar 6 and reset the upper and lower dead points of the needle bar.

SUMMARY OF THE INVENTION

The present invention has been made to solve the foregoing problems with the prior art, and therefore the present invention provides a presser foot drive structure of an embroidery machine, in which the stroke of a presser foot can be set to be smaller than that of a needle bar.

The present invention also provides a presser foot drive structure of an embroidery machine, in which the force supporting a needle bar is enhanced while the shaking of a presser foot is reduced.

The present invention further provides a presser foot drive structure of an embroidery machine, which can facilitate the replacement of a presser foot and eliminates inconveniences, such as the requirement to disassemble a needle bar or reset the upper and lower dead points when replacing the presser foot.

According to an aspect of the present invention, there is provided a presser foot drive structure of an embroidery machine, by which a vertically movable presser foot for preventing a sheet of cloth to be sewn from rising in a sewing operation is vertically moved inside a sewing head. The presser foot drive structure includes a presser foot drive holder, which is vertically slidably mounted on the outer circumference of a vertically driven needle bar; a presser foot drive shaft, which is disposed parallel to the needle bar and mounted on the presser foot drive holder; and the presser foot, which is disposed at the lower end of the presser foot drive shaft and vertically reciprocates.

According to an embodiment of the present invention, the presser foot drive structure may further include a presser foot drive block, which is engaged with the presser foot drive holder, and a presser foot drive lever for driving the presser foot drive block.

According to another embodiment of the present invention, the presser foot may be detachably assembled to the lower end of the presser foot drive shaft.

According to a further embodiment of the present invention, the presser foot drive block may include a body, having a C-shaped cross section, and a connecting member, stored inside the body and having an engaging recess in one side thereof.

According to another embodiment of the present invention, the presser foot drive structure may further include a guide holder, which slides vertically and holds and supports the presser foot drive shaft.

According to yet another embodiment of the present invention, the guide holder may include an upper guide holder, fastened to the presser foot driving holder, and a lower guide holder, disposed at the distal end of the needle bar.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter a presser foot drive structure of an embroidery machine according to an embodiment of the present invention will be described more fully with reference to the accompanying drawings.

Figure 1:
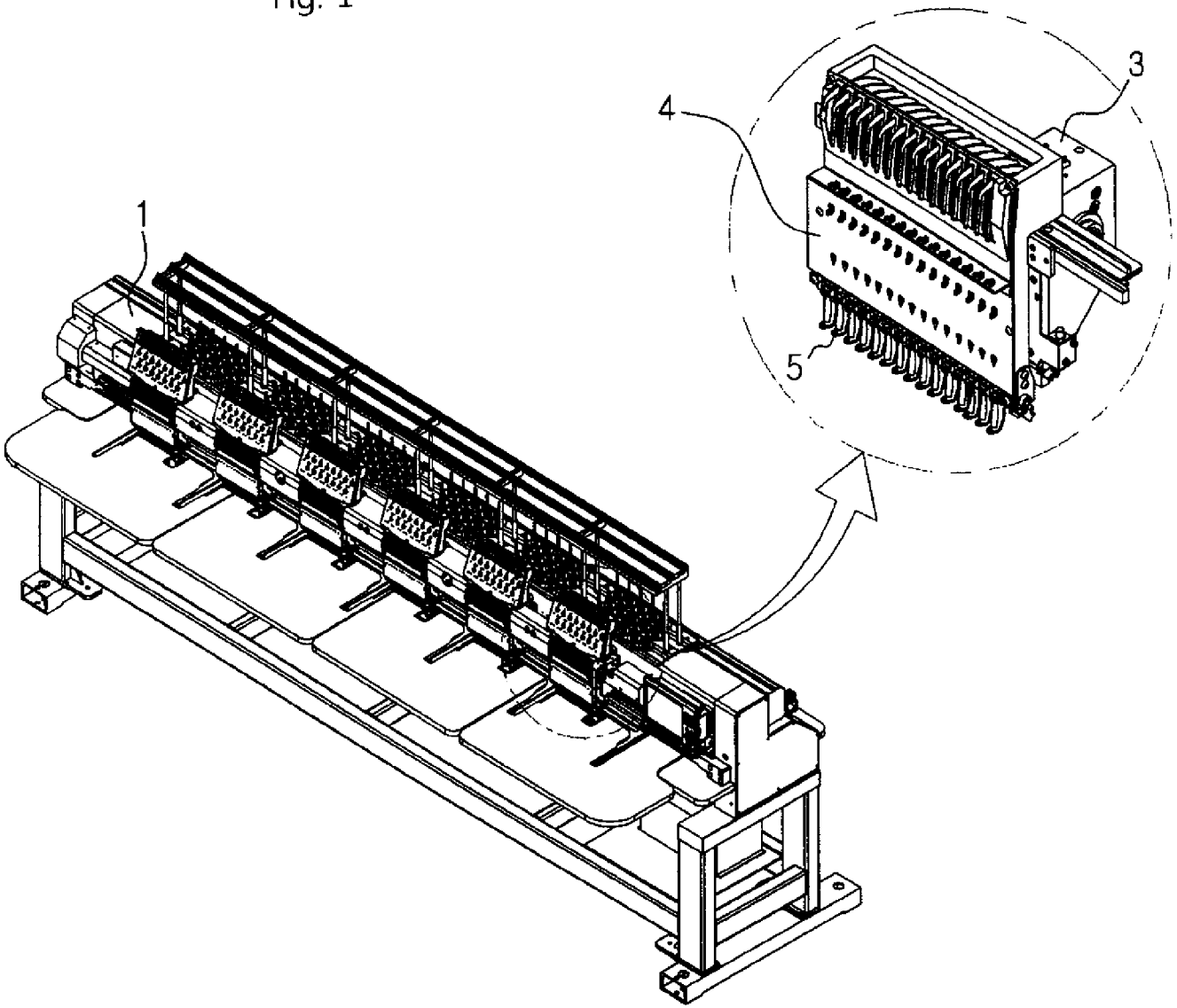
FIG. 1 is a perspective and partially expanded view illustrating an embroidery machine.
Figure 2A:
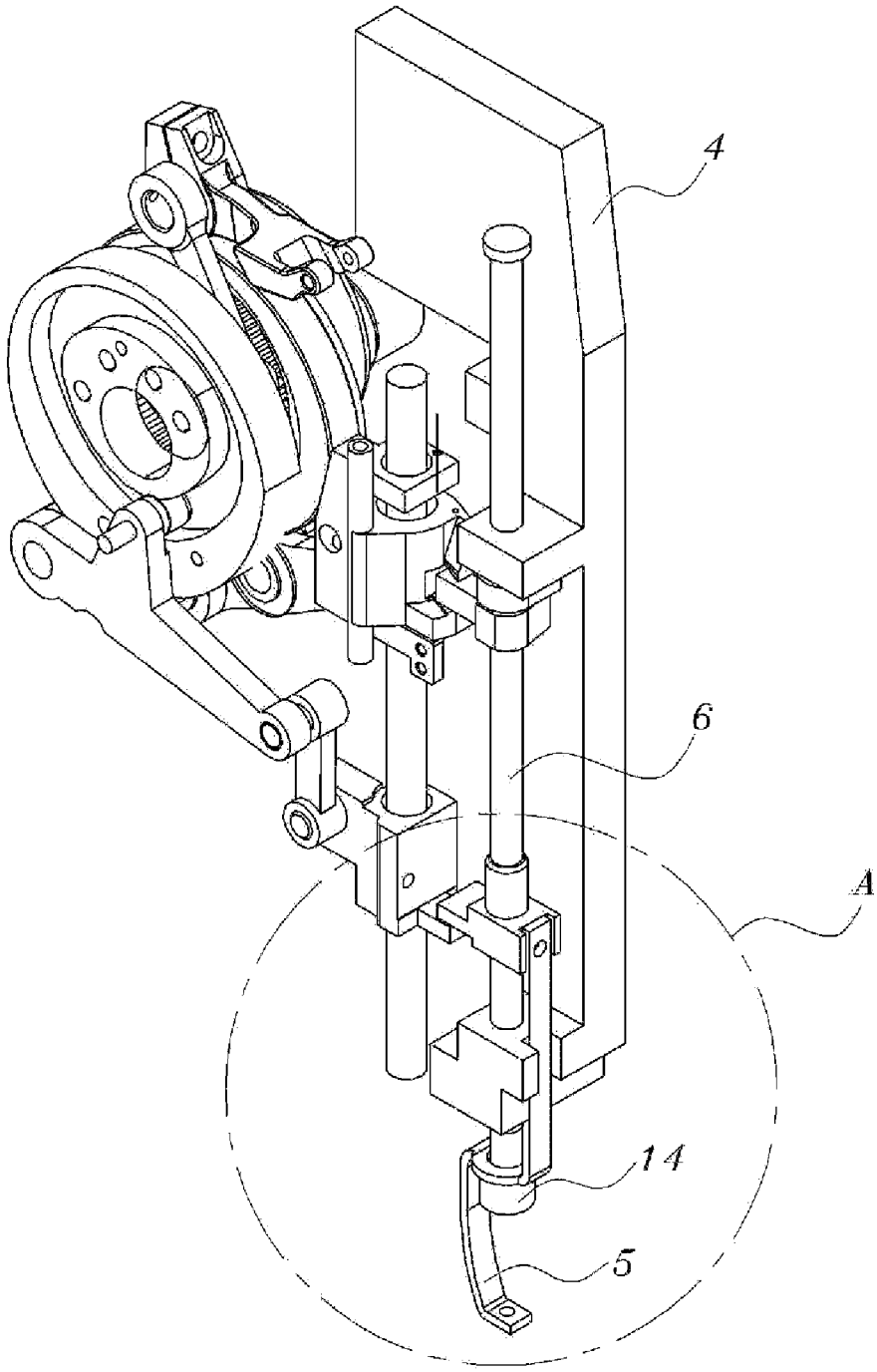
FIG. 2A is a perspective view illustrating a presser foot drive structure of the embroidery machine of the prior art.
Figure 2B:
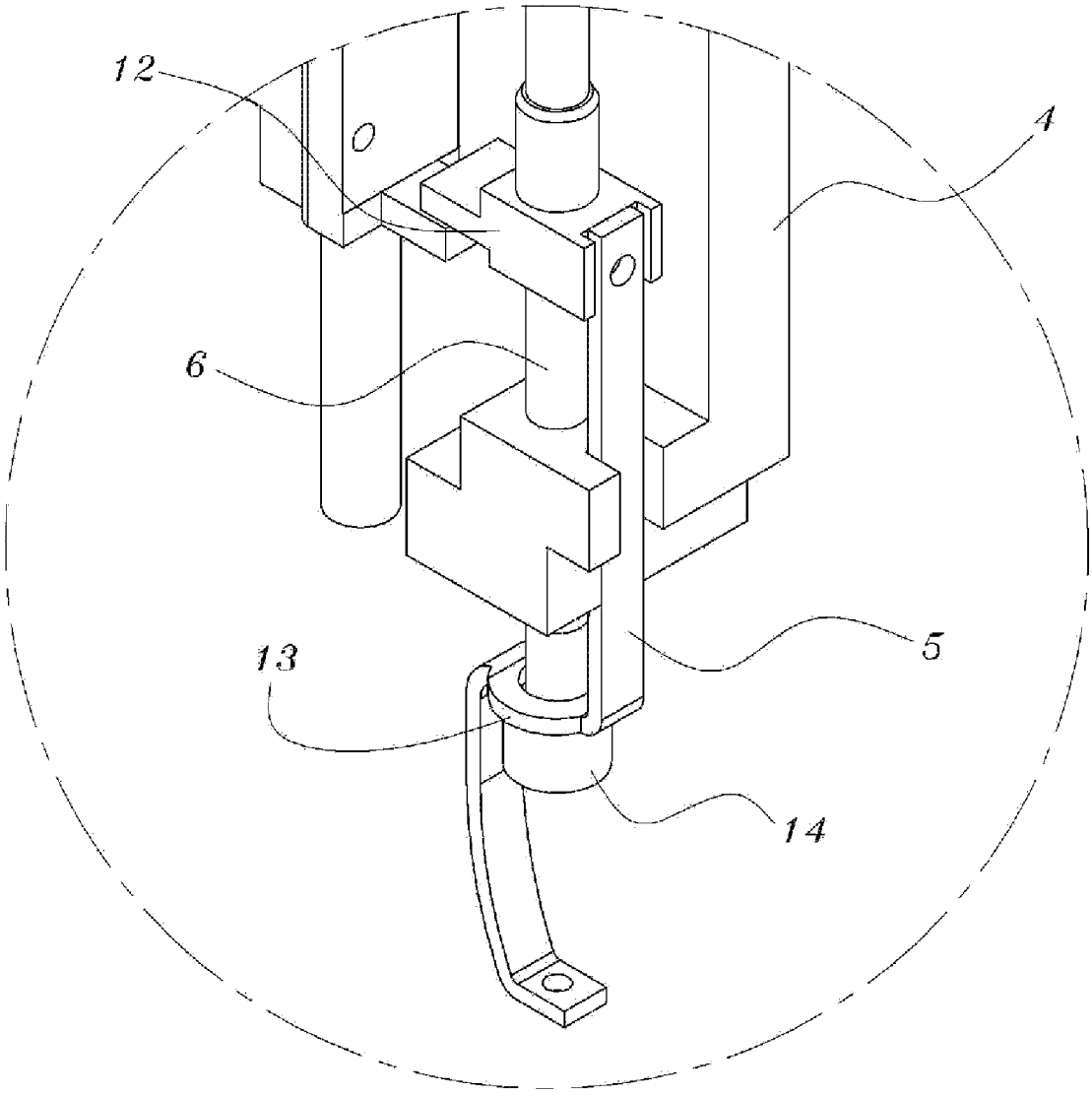
FIG. 2B is an expanded view of part "A" of FIG. 2A.
Figure 3:
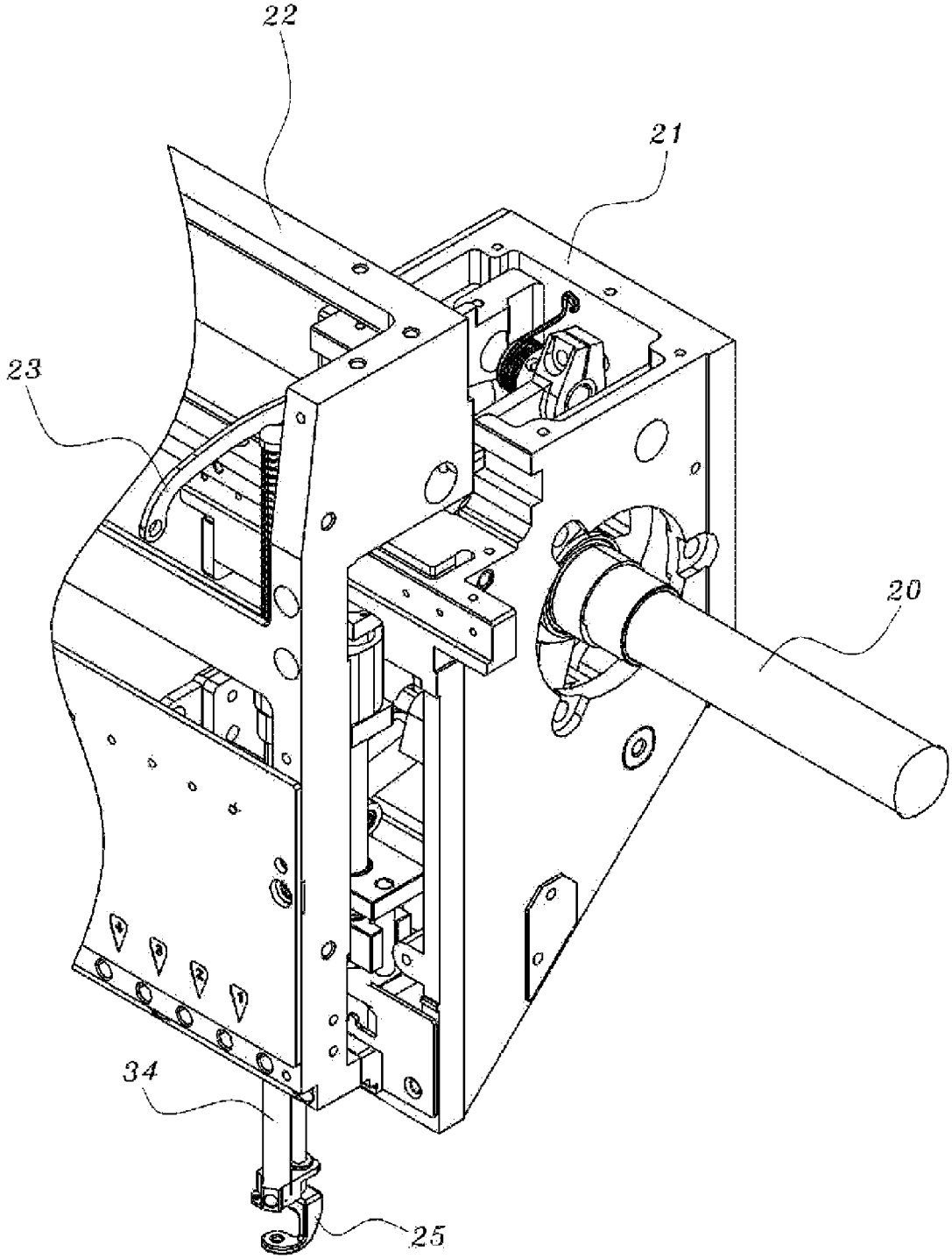
FIG. 3 is a perspective view illustrating the installed state of a presser foot drive structure of an embroidery machine according to an embodiment of the present invention.
Figure 4:
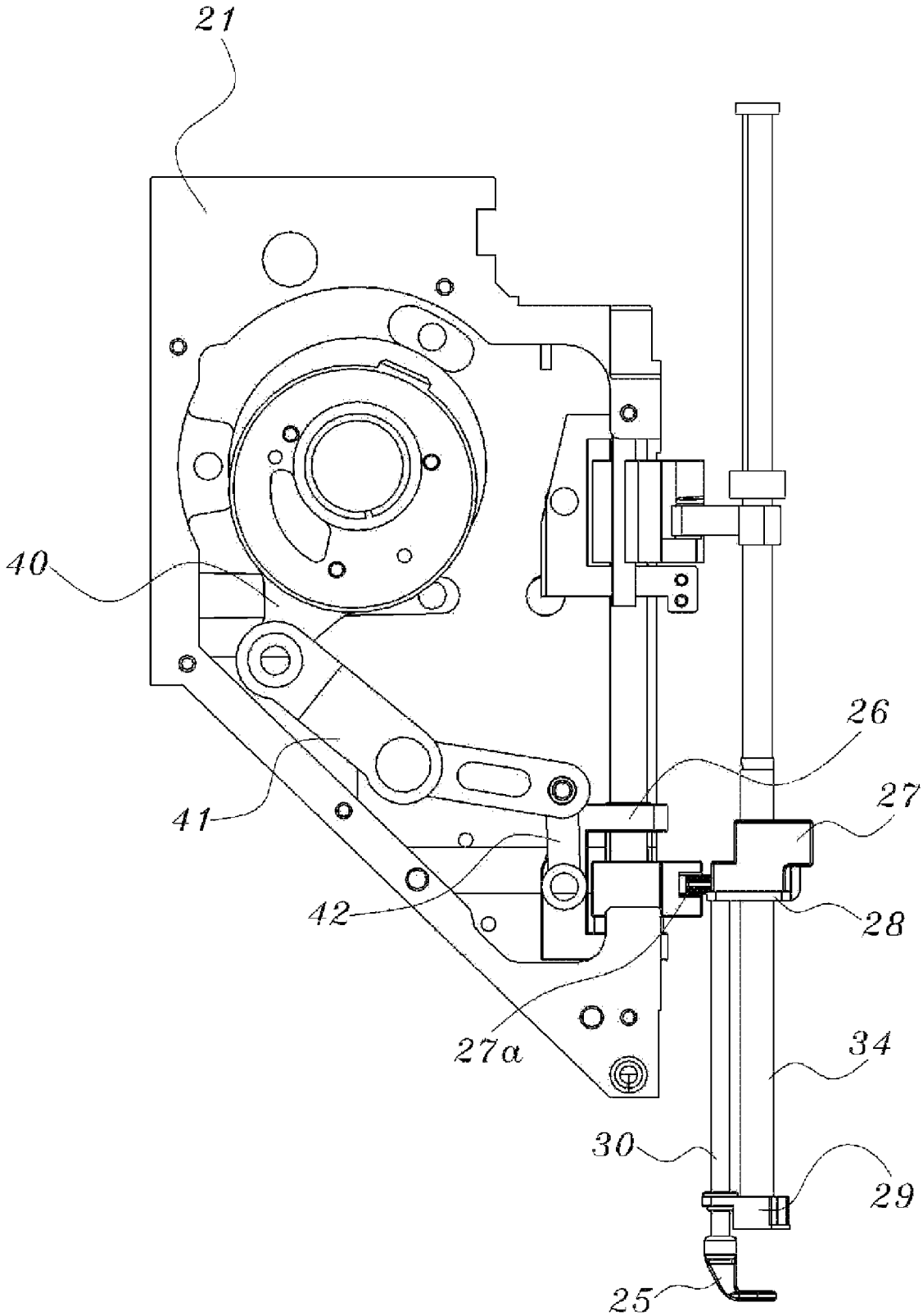
FIG. 4 is a side elevation view illustrating the presser foot drive structure of the present invention.
Figure 5A:
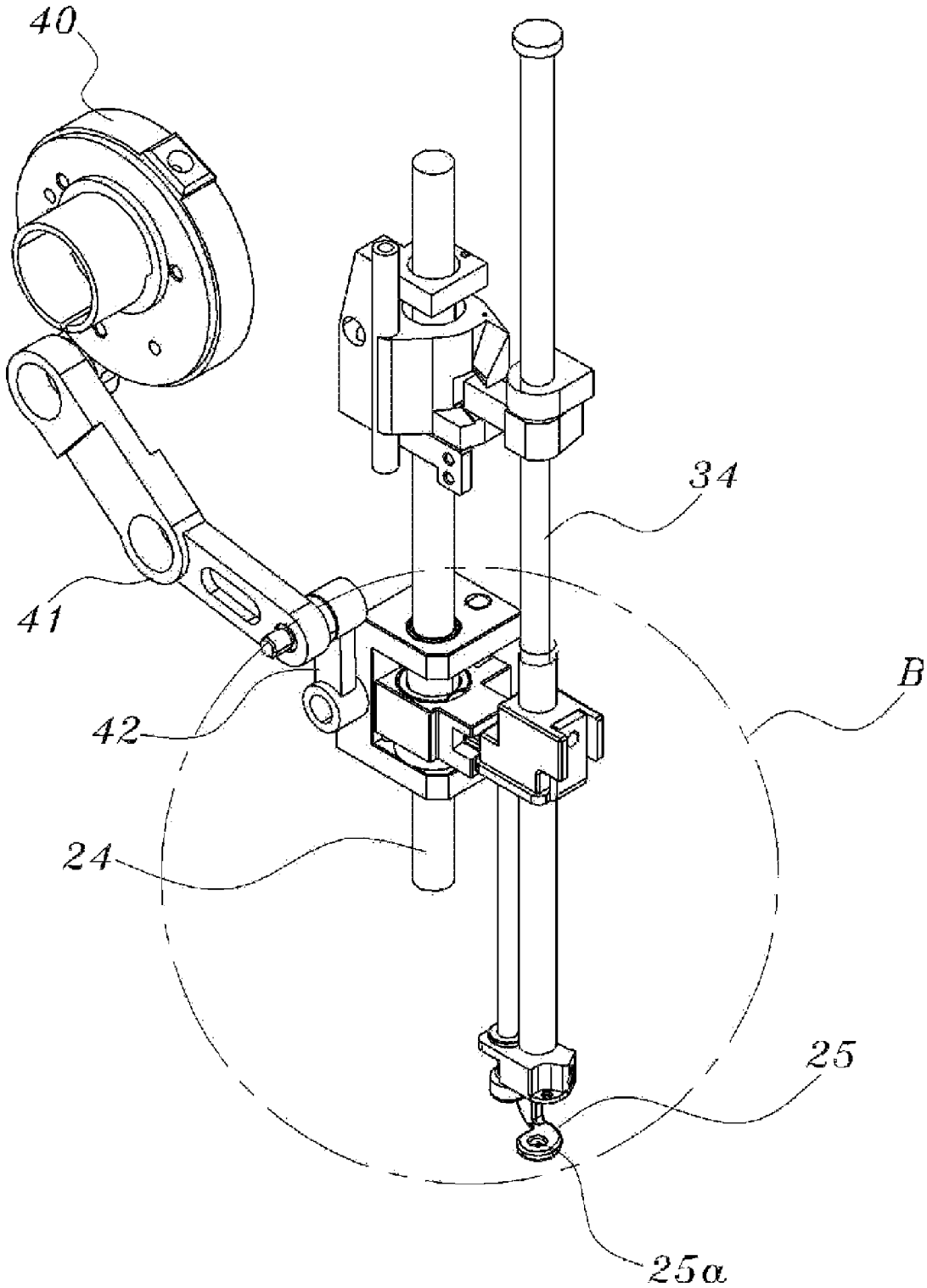
FIG. 5A is a perspective view illustrating the partially installed state of the present invention.
Figure 5B:
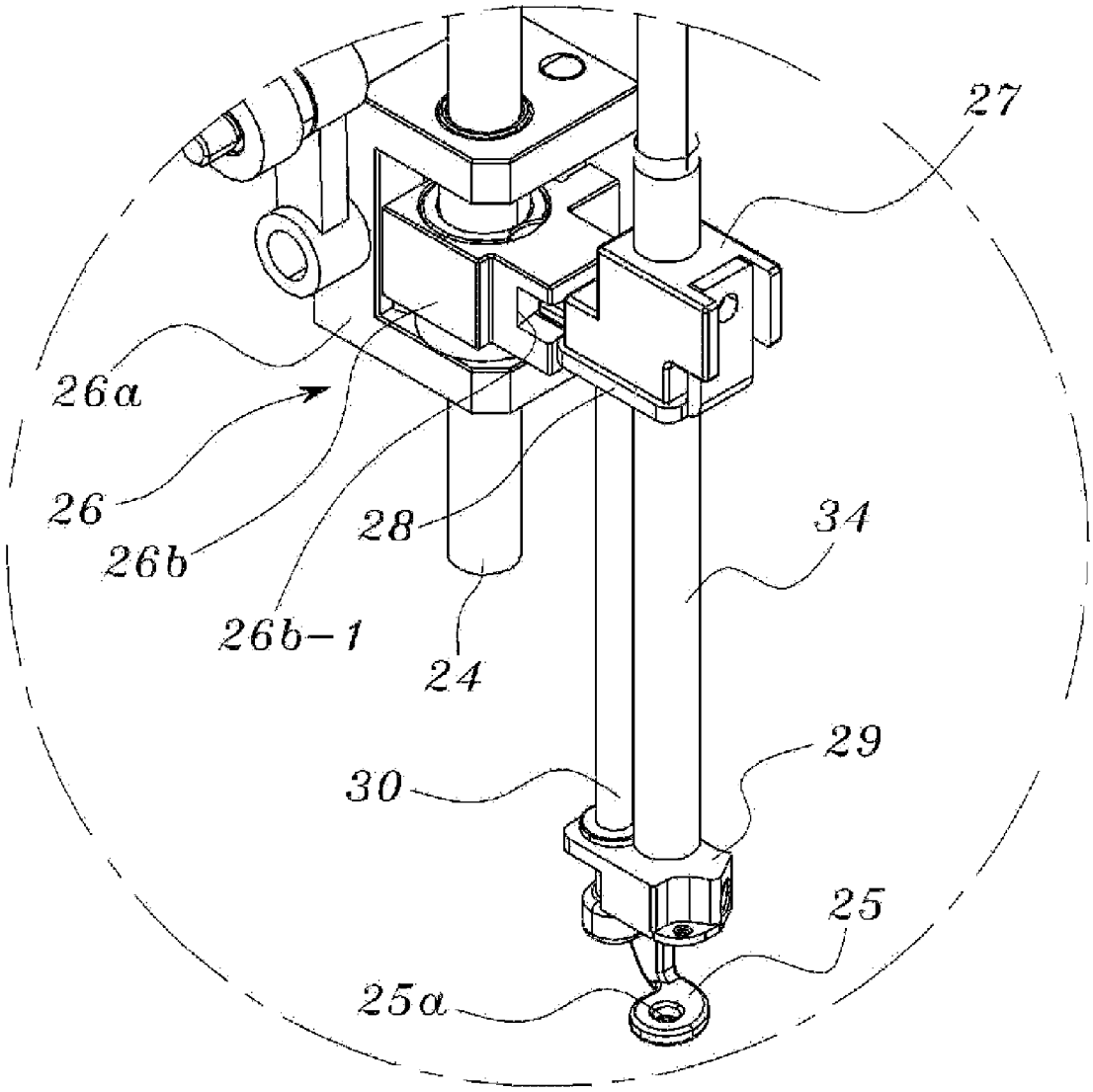
FIG. 5B is an expanded view of part "B" of FIG. 5A.

FIG. 3 is a perspective view illustrating the installed state of a presser foot drive structure of an embroidery machine according to an embodiment of the present invention, FIG. 4 is a side elevation view illustrating the presser foot drive structure of the present invention, FIG. 5A is a perspective view illustrating the partially installed state of the present invention, and FIG. 5B is an expanded view of part "B" of FIG. 5A.

Referring to FIGS. 3 to 5A, the presser foot drive structure of the embroidery machine of the present invention generally includes a presser foot drive holder 27, a presser foot drive shaft 30 arranged parallel to a needle bar 34 via the presser foot drive holder 27, a presser foot 25, which is disposed at the lower end of the presser foot drive shaft 30 and is vertically movable, and guide holders 28 and 29 disposed at lower portions of the needle bar 34, so that the lower portions of the needle bar 34 are inserted into and supported by the guide holders 28 and 29 in a vertically slidable fashion.

As shown in FIGS. 4, 5A and 5B, the presser foot drive holder 27 has a stepped profile when seen from the side, and is vertically slidable and mounted on the outer circumference of the needle bar 34, which vertically extends through the inner circumference thereof. The presser foot holder 27 is also provided with an engaging protrusion 27*a*, which protrudes a predetermined length and is inserted into and supported by an engaging recess, which will be described later.

The upper guide holder 28, as shown in FIGS. 4, 5A and 5B, has an L-shaped cross section when seen from the side. The upper guide holder 28 is in close contact with the presser foot drive holder 27, and the needle bar 34 extends through the inner circumference of the upper guide holder 28. The presser foot drive shaft 30 is fixed, at the top portion thereof, to the underside of the upper guide holder 28, and is arranged parallel to the needle bar 34.

As shown in FIGS. 4, 5A and 5B, the lower guide holder 29 has a diagonally mirrored L-shaped cross section. The lower end (distal end) of the needle bar 34 is inserted into the lower guide holder 29 to a predetermined depth, and the presser foot drive shaft 30 extends through the lower guide holder 29. Accordingly, the upper and lower guide holders 28 and 29 are detachably attached to the needle bar 34 and the presser foot drive holder 27. The upper and lower guide holders 28 and 29 support the presser foot drive shaft 30 such that the presser foot drive shaft 30 is vertically slidable.

As shown in FIGS. 4, 5A and 5B, the presser foot 25 is fastened at the top end thereof to the lower end of the presser foot drive shaft 30, and thus vertically reciprocates together with the needle bar 34.

The presser foot drive structure also includes a presser foot drive block 26, as shown in FIGS. 4, 5A and 5B. The presser foot drive block 26 includes a body 26*a*, which has a C-shaped cross section when seen from the side, and a connecting member 26*b*, which has a substantially T-shaped cross section and is stored inside the body 26*a*. An engaging recess 26*b*-1 having a C-shaped cross section protrudes from one side of the connecting member 26*b*, so that the engaging protrusion 27*a* of the pressure foot drive holder 27 is inserted thereinto. The needle bar drive shaft 24 vertically extends through the body 26*a* and the connecting member 26*b* of the presser foot drive block 26.

A connecting link 42 is fixedly attached at one end thereof to the body 26*a* of the presser foot drive block 26, and is pivotally connected at the opposite end thereof to one end of a presser foot drive lever 41. The presser foot drive lever 41 is connected at the opposite end thereof to a presser foot drive rod 40. Reference numeral 25*a*, which has not yet been described, indicates a needle hole, which a needle passes through.

Now, the operation of the present invention having the above-mentioned construction will be described.

As shown in FIGS. 3 to 5B, when a spindle 20 is rotated by the driving force of a motor (not shown), the presser foot drive rod 40 rotates around the spindle 20 and, concurrently, the presser foot drive block 26, which is connected to the presser foot drive lever 41 via the connecting link 42, is vertically and reciprocally moved.

Concurrently, the needle bar 34, which is connected to the presser foot drive holder 27, which is engaged with the presser foot drive block 26, moves vertically inside a sewing heads 22, and the presser foot 25, which is coupled to the lower end of the presser foot drive shaft 30, which is placed parallel to the needle bar 34, also moves vertically.

As mentioned above, the presser foot 25 moves vertically using the presser foot drive holder 27 and the presser foot drive shaft 30, independent of the vertical movement of the needle bar 34. Unlike a conventional structure, in which the needle bar 34 extends through the presser foot 25, the drive structure of the present invention uses the needle bar 34 as a guide shaft for the vertical movement of the presser foot 25 while allowing the needle bar 34 to vertically move parallel to the presser foot 25, so that the stroke of the presser foot 25 can be set to be small, independently of the stroke of the needle bar 34.

In addition, since the lower guide holder 29 is coupled with the presser foot 25 at the distal end of the needle bar 34, it is possible to enhance the supporting force for the needle bar 34, particularly at a portion where the presser foot 25 is provided, to which the largest external force is applied owing to interference with a sewing material such as a sheet of cloth to be sewn, and also to minimize the shaking of the presser foot 25 using the lower guide holder 29.

Furthermore, since the presser foot 25 is detachably assembled to the presser foot drive shaft 30, when the presser foot 25 is damaged or broken, the presser foot 25 can be easily replaced by detaching it from the lower end of the presser foot drive shaft 30. Moreover, it is also possible to eliminate inconveniences, such as the requirement to disassemble the needle bar 34 or reset the upper and lower dead points in the event of replacement of the presser foot 25.

According to the present invention, as set forth above, the presser foot drive structure is operated independently from the structure for vertically lifting and lowering the needle bar, so that the reduced stroke of the presser foot can decrease noises and vibration in the sewing head.

In addition, the optimum stroke of the presser foot, which can minimize noises and vibration in the sewing head, can be easily realized.

The presser foot drive holder and the guide holder, disposed at the distal end of the needle bar, can enhance the supporting force for the needle bar, particularly at a portion where the presser foot is provided, and can also reduce the shaking of the presser foot.

Furthermore, since the presser foot has a detachable configuration, it is easy to replace the presser foot, and it is unnecessary to disassemble the needle bar or reset the upper and lower dead points.

Although the presser foot drive structure of an embroidery machine of the present invention has been described with reference to the drawings, the present invention is not intended to be limited by the above illustrated embodiment and drawings. Rather, it should be understood that those skilled in the art can make various modifications and variations without departing from the scope of the present invention as defined in the accompanying claims.

What is claimed is:

1. A presser foot drive structure of an embroidery machine, by which a vertically movable presser foot for preventing a sheet of cloth to be sewn from rising in a sewing operation is vertically moved inside a sewing head, the presser foot drive structure comprising:

a presser foot drive holder vertically slidably mounted on an outer circumferential portion of a needle bar, which is vertically driven;

a presser foot drive block including a body, a connecting link being fixedly attached at one end of the connecting link to the body and being pivotally connected at the opposite end of the connecting link to one end of a presser foot drive lever which is connected to a presser foot drive rod at the opposite end of the presser foot drive lever;

an engaging recess that engages the presser foot drive block with the presser foot drive holder, the engaging recess being protruded from a connecting member inside the body and being inserted into by an engaging protrusion disposed in the presser foot driver holder;

a presser foot drive shaft disposed parallel to the needle bar via the presser foot drive holder; and the presser foot, disposed at a lower end of the presser foot drive shaft to vertically reciprocate.

2. The presser foot drive structure according to claim 1, further comprising the presser foot drive lever that drives the presser foot drive block.

3. The presser foot drive structure according to claim 2, wherein the body has a C-shaped cross section.

4. The presser foot drive structure according to claim 2, wherein the presser foot is detachably assembled to the lower end of the presser foot drive shaft.

5. The presser foot drive structure according to claim 1, wherein the presser foot is detachably assembled to the lower end of the presser foot drive shaft.

6. The presser foot drive structure according to claim 1, further comprising a guide holder vertically slidably holding and supporting the presser foot drive shaft.

7. The presser foot drive structure according to claim 6, wherein the guide holder comprises:

an upper guide holder fastened with the presser foot driving holder; and a lower guide holder disposed at a distal end of the needle bar.

8. A presser foot drive structure of an embroidery machine, by which a vertically movable presser foot for preventing a sheet of cloth to be sewn from rising in a sewing operation is vertically moved inside a sewing head, the presser foot drive structure comprising:

a presser foot drive holder vertically slidably mounted on an outer circumferential portion of a needle bar, which is vertically driven;

a presser foot drive shaft disposed parallel to the needle bar via the presser foot drive holder;

the presser foot, disposed at a lower end of the presser foot drive shaft to vertically reciprocate; and a presser foot drive block engaged with the presser foot drive holder, and a the presser foot drive lever that drives the presser foot drive block, wherein the presser foot drive block includes:

a body having a C-shaped cross section; and a connecting member stored inside the body and having an engaging recess in one side thereof.

* * * * *